United States Patent [19]

Chekroun

[11] Patent Number: 5,001,495

[45] Date of Patent: Mar. 19, 1991

[54] ADAPTIVE MICROWAVE SPATIAL FILTER OPERATING ON-REFLECTION, AND A CORRESPONDING METHOD

[75] Inventor: Claude Chekroun, Gif Sur Yvette, France

[73] Assignee: Thomson-CSF Radant, France

[21] Appl. No.: 718,962

[22] Filed: Jan. 18, 1985

[30] Foreign Application Priority Data

Jan. 23, 1984 [FR] France ..... 84 00998

[51] Int. Cl.[5] ..... H01Q 19/06

[52] U.S. Cl. ..... 343/754

[58] Field of Search ..... 343/754, 756, 909, 381, 343/384

[56] References Cited

U.S. PATENT DOCUMENTS 4,518,966 3/1986 Sadones ..... 343/754

*Primary Examiner*—Theodore M. Blum

*Attorney, Agent, or Firm*—Pollock, VandeSande & Priddy

[57] ABSTRACT

The invention pertains to a modulation method at pick-up of the amplitude of the secondary lobes of the radiation pattern for a hyperfrequency antenna and the method application for sensing and eliminating the jamming effects of jammers.

According to the invention, we place as a filter (4) close to the reflector (1) which reflects the transmission-pick-up beam of the antenna, the filter having at least one network of conductive wires loaded with variable controllable resistors, such as diodes. During transmission, we make the filter (4) transparent by having strong equal currents travel through the wires, while at pick-up we modulate the amplitude of the currents traveling through the wires in order to obtain the desired distortions of the pattern.

The invention especially applies to the sensing and elimination of the jamming effects produced by jammers.

9 Claims, 3 Drawing Sheets

ADAPTIVE MICROWAVE SPATIAL FILTER OPERATING ON-REFLECTION, AND A CORRESPONDING METHOD

FIELD OF THE INVENTION

The invention relates to an adaptive microwave spatial filter and a method of use to localize and inhibit jammers and their effects.

BACKGROUND

In U.S. Pat. No. 4,344,077 a method is described which makes it possible to eliminate jamming activities stemming from jammers that transmit toward a radar antenna of which the aim direction is shifted in relation to the line which connects the antenna to the jammer. This method rested on using an appropriately made filter one that was properly controlled and located in front of the antenna. With such a filter it is possible to modulate the amplitude of the secondary lobes in the radiation pattern of the antenna especially by creating "dips", which one could shift in an angular direction according to the aim direction of the antenna. By making the aim direction of the dip coincide with the transmission orientation of the jammer (in relation to the antenna), one could thus eliminate the effect of the jamming.

The same patent describes a method which made it possible to sense the position of a jammer by assessing the point at which jamming no longer constitutes a significant problem. Such a search based on "negative effect" is fairly delicate and not very accurate, especially in view of the residual noise level of the antenna.

In U.S. Pat. No. 4,518,966 a filter is described that made it possible to generalize the inhibitive activity of jammers for every microwave antenna with a given polarization direction, whereas in the above mentioned U.S. Pat. No. 4,344,077, attenuation was only possible to the extent that the microwave frequency would transmit a linearly polarized wave. In the more recent patent, there was no description for a particular method to search and assess the position of a jammer, since one was referred for that search to the "negative effect" procedure which was laid out in the eariler patent.

All above mentioned adaptive microwave filters operate on transmission, since they are "transparent" on emission and "modulated" for the secondary lobes of the antenna beam on reception. When they operate at transmission, the panels must be placed in front of the transmitter, or between the transmitter and the observed space volume, which sometimes creates installation constraints which are hard to resolve.

The purpose of the invention is a new adaptive microwave spatial filter, which operates on reflection and not on transmission. Furthermore, one purpose of the invention is to improve and facilitate the search for and assessment of the position of a jammer that transmits towards a radar antenna which is outfitted with such a filter.

The modulation method for reception of the amplitude of the secondary lobes of the radiation pattern for a microwave antenna in conformance with the invention is basically characterized by the following steps:

we place, acting as a filter close to the reflector which reflects the transmit/receive beam of the antenna, at least one network of conductive wires that include resistors, such as diodes whose resistance vary constantly according to the intensity of the currents to diodes conduct;

during the transmission phase of operation of the antenna, we produce polarizing currents which are preferably equal to about several milliamperes which flow through all the wires in the conducting direction of the diodes;

during the reception phase of operation of the antenna, we produce uneven polarizing currents which flow through each wire, and which vary by several microamperes to several milliampers in the conducting direction of the diodes in order to create useful space current distributions that modify or modulate the level (amplitude) of the desired secondary lobes of the radiation pattern through attenuation, elimination or increase.

In this way, without introducing a significant distortion in the beam during transmission, we may distort, in a desired way, at reception specific secondary lobes of the radiation pattern, thus making possible for instance the search and/or elimination of jammers, as it will be shown more clearly in the description that follows.

The method of the invention can be used especially to search for jammers. In this instance, we advantageously allow the current distribution to vary, in the wires of the network(s) comprising the space filter, so as to shift along the entire radiation pattern of the antenna (during reception) a bulge, overintensification or localized increase of a secondary lobe until the noise peaks are attained on the radiation pattern of the antenna. We assess and note at each point the position of the bulges that correspond to those peaks, and we instantly deduce the aim direction of the jammers.

In order to eliminate the effect of the jammers, it is sufficient to cancel the secondary lobe of the radiation pattern of the antenna which is located in the direction of the jammer by selecting and applying an appropriate current distribution in wires of the network(s) comprising the spatial filter.

Preferably, the active filter includes two connected networks of broken conductive lines that are made of segments of series assembled conductive wires, including variable resistors like diodes. The wires are supplied with variable intensity currents that can be modulated from one line to the next and placed from one network to the next so that the segments which belong to each network cross and intermingle without electric contact from one network line to the adjacent line of the other network. The lines are made of fairly equal successive wire segments arranged accordng to a bending surface which is more or less continuous and substantially orthogonal from one segment to the next. The network is comprised of a family of such substantially parallel lines arranged at a substantially constant distance from one line to the next. When we proceed in this manner, the filter is effective regardless of the polarization direction of the microwave frequency wave that is transmitted and/or picked up by the antenna, which is obviously an advantage especially when it involves eliminating the effects of jamming stemming from jammers that transmit with any form of polarization.

According to a preferred implementation the filter is comprised of a network which includes two sub-networks of rows of wires or segments of substantially parallel conductive wires that are aimed respectively according to an overall local direction X and according to a substantially orthogonal general direction Y so as to comprise a network of grid-like meshes, said wires being interrupted from one distance to the other by adjustable, variable resistor elements, preferably like diodes. In this manner, the assembly of the two networks which cross acting as a network of square meshes is simplified and such a network can be easily conformed according to any desired bend.

The invention, its implementation and its applications will be more clear with the description that follows designed as a reference to the attached drawings wherein.

Figure 5:
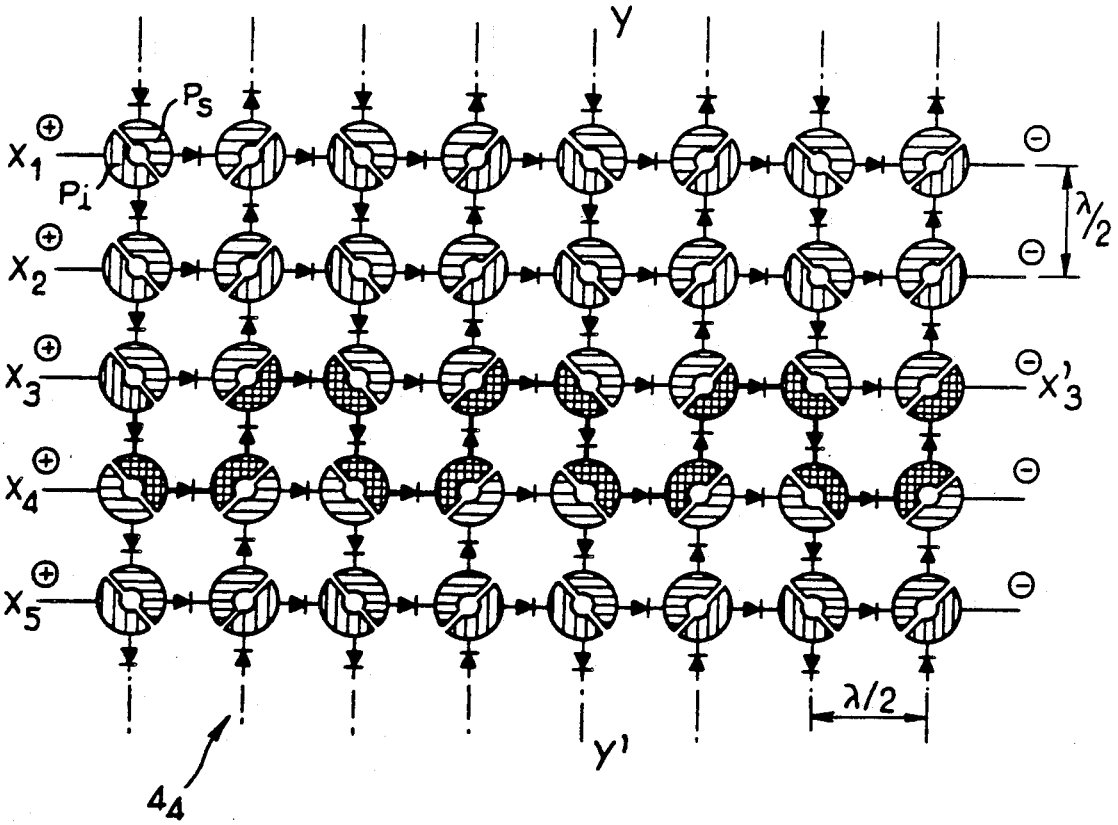
Figure 3:
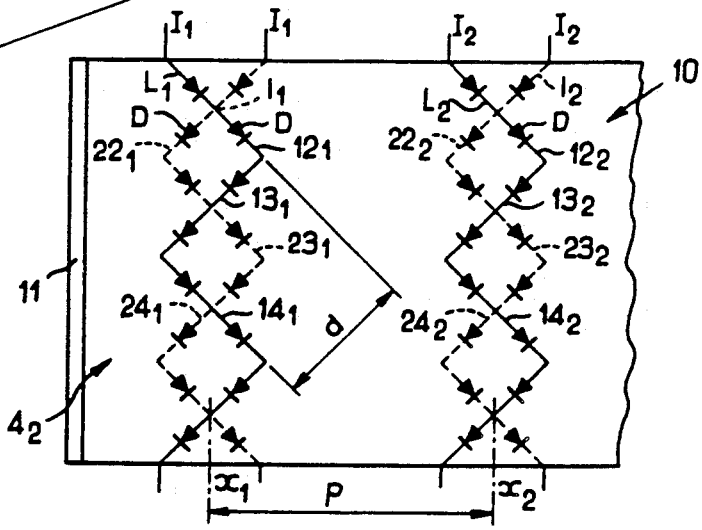
FIG. 3 depicts schematically from a side view an altered filter which can be preferably used.
Figure 4:
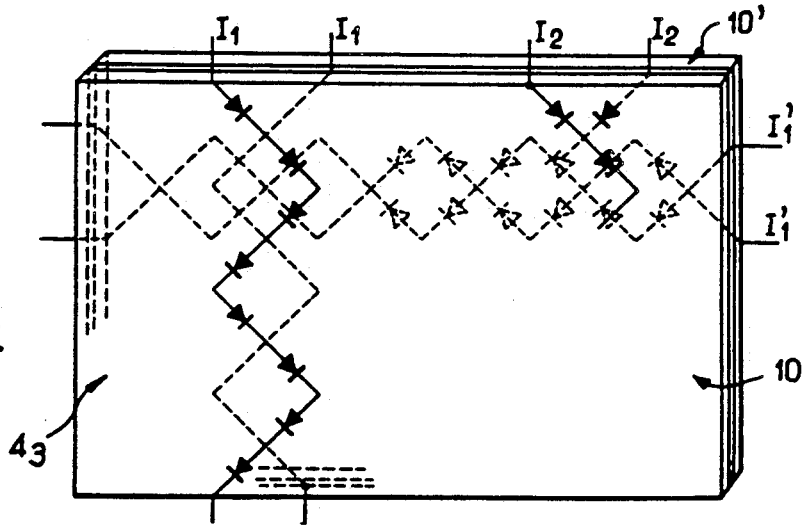
FIG. 4 depicts another altered filter as in FIG. 3.
Figure 6:
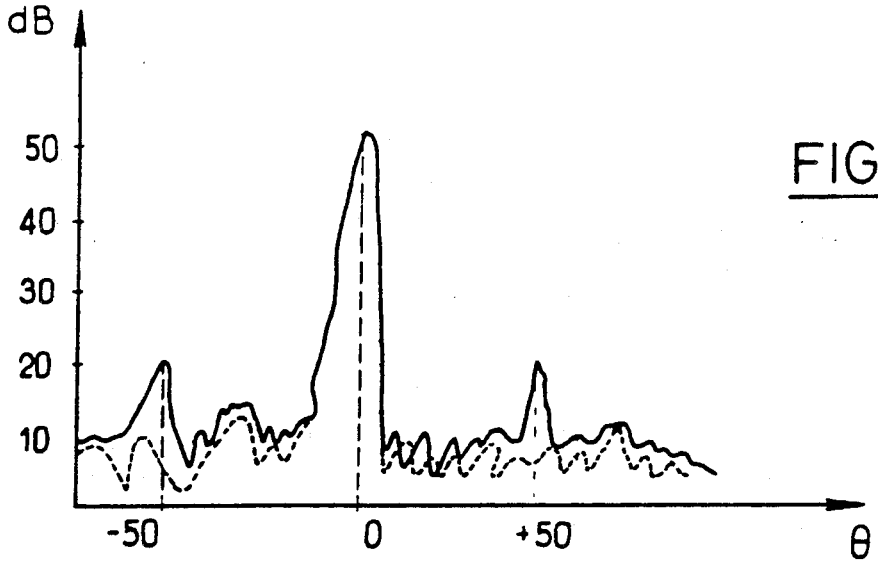
Figure 7:
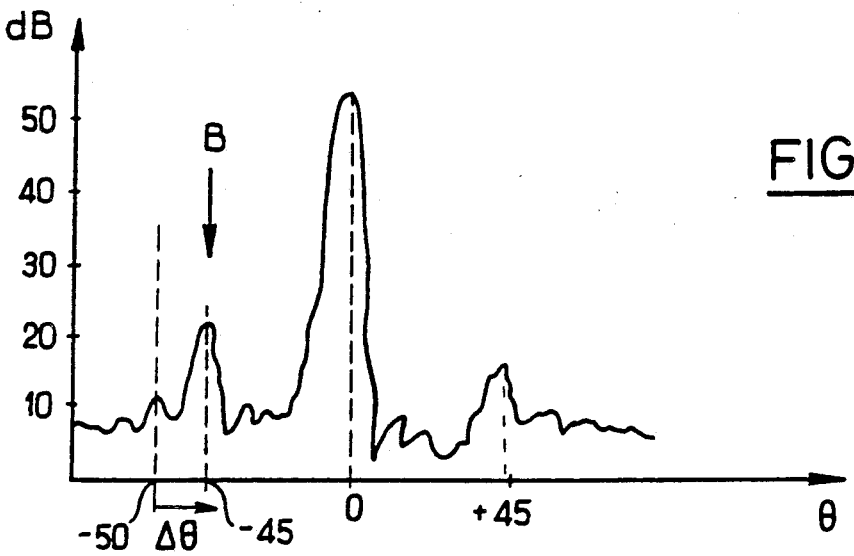

FIG. 5, like FIGS. 3 and 4, depicts a preferred implementation of a network comprised of two sub-networks that act as a filter, and which can be used according to the invention, FIGS. 6 and 7 are diagrams which explain the use of the method for sensing and eliminating the effects of jammers.

Figure 1:
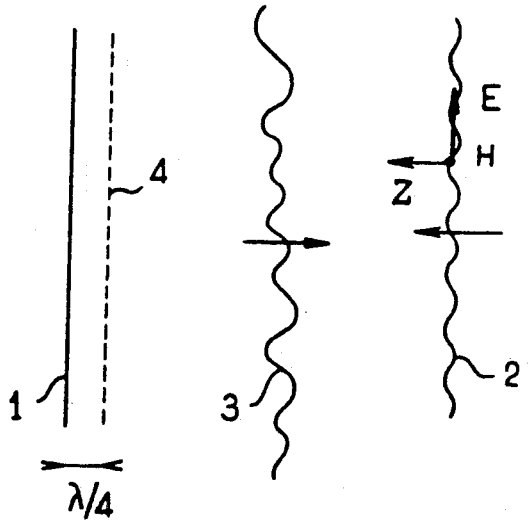
FIG. 1 depicts schematically the operating principle of a spatial filter that can be adapted to reflection according to the invention.

Referring first of all to FIG. 1, we identify as 1 the surface of the reflector on which the microwave energy 2 reflects, after being reflected the microwave energy will be sent returned to the source (which is not depicted on the drawings). Usually, the surface of the reflector is concave, for instance paraboloid in order to send back the wave that is picked up at the center of the paraboloid where the source of the transmitter-receiver of the antenna is located.

The wave which is reflected by the reflector 1 is returned as indicated by 3. In conformance with the invention, we place in front of the reflecting panel 1 (which can be comprised of a metal or metalized surface) an adaptive microwave spatial filter 4 of which several constituent examples will be later described. This filter 4 is controlled so that during a transmission phase of operation of the antenna the filter, is almost "transparent" in relation to the transmitting beam of the antenna. During a reception phase of operation the filter introduces a particular modulation of the amplitude of the secondary lobes of the antenna radiation pattern. In FIG. 1, we showed that the wave 2 which impinges on the reflector 1 was distorted after being reflected on reflector 1 and following a double crossing of the filter 4, the distortion of the wave being translated into a modulation of the amplitude illustrated in the drawing.

The filter 4 is preferably arranged at a distance which is substantially equal to $\lambda/4$ from the surface of the reflector 1 with which it is parallel, $\lambda$ being the average wavelength of the microwave energy processed by the antenna.

Figure 2:
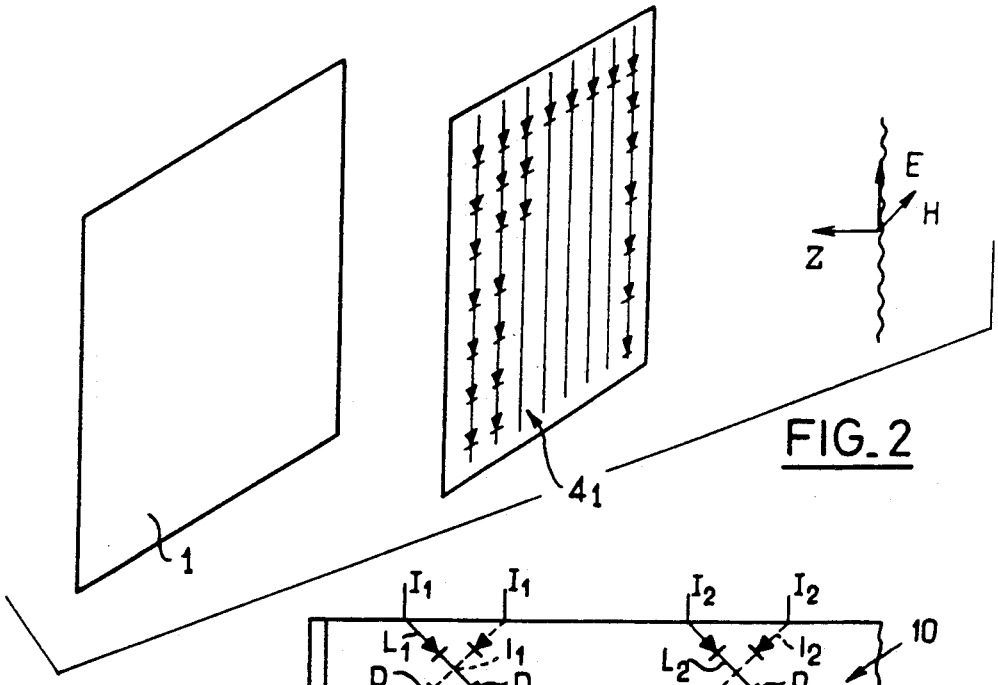
FIG. 2 depicts in a perspective view and schematically the make-up of a reflective spatial filter according to the invention.

According to the simplified as implementation shown in FIG. 2, the filter $4_1$ is comprised , as described in the above mentioned U.S. Pat. No. 4,344,077 of a network of conductive parallel wires including diodes which are oriented parallel to the electric field vector $\vec{E}$ of the microwave energy that crosses the network.

Under such circumstances, by following the various assembly data which are mentioned in the above mentioned patent, especially corresponding to the spacing between wires, to the spacing of diodes on the wires, etc., we can obtain a modulation on reception of the secondary lobes of the antenna radiation pattern. This effect is produced by modulating in a corresponding way the electric currents which flow in the wires of network $4_1$.

More accurately, when we want network $4_1$ to be "transparent" (during transmission by the antenna), we control the feed of strong currents, for instance approximately 10 milliamperes, for the various wires of the network, the microwave energy which crosses network $4_1$ in this case both prior to and following reflection on the reflector 1 without significant alterations of the beam. On the other hand, during reception phase of operation, we modulate the various currents which flow in the various wires of the network according to a set distribution law which allows different currents to flow in the various wires from several microamperes to several milliamperes, so as to generate the desired modulation of the secondary lobes for the beam which is picked up by the antenna.

More accurately, we show in FIG. 6, with a dotted line, the radiation pattern on transmission by the antenna which is practically not affected by the insertion of network $4_1$ when all the diode-wires from that network carry strong currents which are all equal to about ten milliamperes for instance. In FIG. 6 the shows azimuth at the ordinates corresponding amplitudes of the various lobes measured in De decibels. FIG. 6 shows the main lobe aimed at angle $\theta$ equal to zero. During reception, the filter $4_1$ is controlled with a modulated current, each wire of the network carrying a current with a set intensity, ranging from several microamperes to several milliamperes, disturbing the radiation pattern, basically at the level of the secondary antenna lobes which are distorted as depicted by the full line curve of the same FIG. 6 (the main lobe is visibly not affected at the scale of the drawings).

We observe on the continuous line curve in FIG. 6 that we generated two bulges, overintensifications or localized increases of the secondary lobes for angles $\theta$ equal to $-50$ degrees and $+50$ degrees respectively.

With appropriate modulation of that current amplitude modulation, we can shift the bulges and we can also shift the dips on each side of angle $\theta+0$ degrees in order to over-intensify or attenuate the desired antenna secondary lobes.

When we want to favor overintensification of the bulges, we conduct very sharp modulations of the amplitude, so as to obtain an increase of at least ten or fifteen decibels for some of the secondary lobes. Such a method of operation is very useful in searching for a jammer.

Thus, as shown in FIG. 7, we shifted the bulge or localized increase which is located at $-50$ degrees towards the angle $-45$ degrees. If a jammer B is located in that direction, the fairly high level of the hump or localized increase will provide a very strong jamming signal which will make it possible to instantly assess the value of the angle $\theta$ under consideration. The angle or localized jammer is known since it directly depends on the known modulation law that is applied to the filter. From now on, if we want to eliminate the effect of the jammer, we simply have to switch the control of the modulation for the filter so as to produce reception radiation pattern of the antenna for that angle $\theta$ the corresponding dip, which will be formed preferably from a low modulation of the amplitude in order to reduce to a minimum the background "noises" which are picked up by the antenna from that direction.

The filter $4_1$ which is described in FIG. 2 only allows, as mentioned earlier, the processing of linearly polarized microwave energy.

If we want to process a wave with any polarizing direction, we can use a filter $4_2$, of the kind that is illustrated in FIG. 3 the make-up of which is described in the above-mentioned U.S. Pat. No. 4,518,966. In this regard, we recall that the filter $4_2$ is comprised of a support sheet or substrate made from a dielectric material 11 that bears on one side (as shown in continuous lines) conductive broken lines L1, L2, etc. each made up of segments of conductive wires indicated by $12_1$, $13_1$, $14_1$ . . . $12_2$, $13_2$, $14_2$ . . . each of which include a diode D. The successive segments are arranged more or less orthogonally so that the overall direction of lines like L1, L2, etc. . . . are straight parallel lines $x_1$, $x_2$, . . . .

On the other side of the sheet, made of a dielectric material 11, a connected network of conductive lines is placed (shown in discontinuous lines) $1_1$, $1_2$, etc. . . . which are more or less symmetrically pointed, so that each segment, like $22_1$, $23_1$, $24_1$ . . . $22_2$, $23_2$, $24_2$ . . . of lines $1_1$, $1_2$ . . . possess the same general direction $x_1$, $x_2$ . . . as the connected lines $L_1$, $L_2$ . . . , the middle of the orthogonal wire segments cross exactly on lines $x_1$, $x_2$ . . . .

When the panel has to be transparent, especially during a transmission phase of operation of the antenna, we make significant currents flow through each line like $L_1$, $L_2$ . . . $1_1$, $1_2$ . . . of about several milliamperes which are all equal and that border the saturation currents of the diodes. Under such circumstances, the filter which is placed at a distance $\lambda/4$ from the reflector 1 only introduces a slight uniform phase shift of about several degrees.

During reception phase of operation the various currents which flow in the connected lines of both networks are modulated with an electronic switch (not depicted) according to the attenuation or overintensification effect that we want to obtain from a particular secondary lobe. The fact that two cross connected networks of conductive broken lines are used, and carry the same currents, makes it possible to attenuate or overintensify the secondary lobe in a specified direction regardless of the polarizing direction of the picked-up wave.

According to the variation of filter $4_3$ as shown in FIG. 4, this filter is comprised of two filters which are identical to those of FIG. 3 that are placed one against the other in substantially orthogonal directions. With such an arrangement, the localization search for a jammer can be conducted right away on bearing or on site with the same process as that which was previously functionally described for FIGS. 6 and 7.

According to the implementation variation which is illustrated in FIG. 5, the filter $4_4$ is comprised of subnetworks of wires including diodes, or diode-wires, that are respectively oriented according to an overall direction X and according to the general orthogonal direction Y.

In practical terms, we can complete an assembly on only side of a support plate made from an appropriate quality plastic substance (not depicted). In accordance with a printed circuit method, we provide a grid of square meshes with a $\lambda/2$ side ($\lambda$ being the average length of the electromagnetic wave that is processed by the antenna), each node of the grid being implemented by a small conductive metal plate with the general shape of a ring-like pellet. Each pellet is sub-divided into two half-pellets referred to respectively as Ps (upper plate with horizontal stripes) and P1 (lower plate with vertical stripes) which are electrically separated from one another by a space or a break.

From those plates, it is possible to achieve the electric feed of all the wire segments which bring together in twos each adjacent plate, on only one side of the same support plate, so that, by feeding the network of filter $4_4$ with one of its segments (to the left on the figure) as referred to with signs (+), and by collecting the feed on the other segment (to the right on the figure) as referred to by the signs (−), it is possible to feed each segment of grid-like meshes with one diode. On the figure, we indicated in a particular way, for easy tracking, a continuous current path according to line $X_3$, $X'_3$.

When all the wires of the network are traveled by strong, equal currents, the filter $4_4$ is transparent. When the control currents that cross the various lines $X_1$, $X_2$, $X_3$ . . . are modulated appropriately, we obtain the desired corresponding modulation by amplifying and/or attenuating the secondary lobes of the antenna radiation pattern. Because of the grid-like aspect of the network with $\lambda/2$ wide meshes, the filter operates regardless of the polarizing direction of the microwave signal that is picked up by the antenna. Furthermore, such a grid which includes such ring-line pellets at each node of the grid can be instantly conformed in order to follow any bend required by the reflector 1.

I claim:

1. A method of amplitude modulating secondary sidelobes of a microwave antenna comprising the steps of:

(a) providing a spatial filter comprising a conductive network with at least a plurality of conductors, each of said conductors having one or more diodes located therein, each of said diodes exhibiting a resistance which varies with current passing through said diodes, (b) locating said spatial filter adjacent a reflector of said antenna, (c) applying current to conductors of said network, (d) controlling current flowing in individual conductors of said network during a transmission phase of operation of said antenna to provide equal currents flowing through all said conductors, so that a radiation pattern of said antenna is substantially unaffected by said filter, and (e) controlling current flowing in individual conductors of said network during a reception phase of operation to be unequal throughout said conductors to modify said antenna radiation pattern to form a localized increase in a secondary lobe of said radiation pattern.

2. A method of localizing jammers as recited in claim 1 and further including the steps of:

(f) repeatedly effecting said controlling step (e) to controllably shift said localized incrase, (g) identifying noise peaks as a function of said localized increase, and (h) localizing a jammer as associated with locations of said localized increase corresponding to noise peaks.

3. A method of reducing or eliminating an effect of a jammer as recited in claim 2 and further comprising the step of:

(i) controlling current flowing in individual conductors of said network to be unequal throughout said network to eliminate a secondary lobe of said antenna radiation pattern associated with location of said jammer.

4. A spatial filter for use in modifying a radiation pattern of a microwave antenna comprising:

a network formed of plural conductors, each including resistance means exhibiting a variable resistance as a function of electrical current flowing therethrough, control means coupled to said conductors for controlling electrical current flowing therein, said control means, during a transmission phase of operation subjecting all said conductors to substantially equal electrical current of at least about several milliamperes, said control means, during a reception phase of operation subjecting conductors to substantially unequal electrical current for forming at least one localized increase in a secondary lobe of said antenna radiation pattern, and means for locating said spatial filter adjacent a reflector of said antenna.

5. A spatial filter as recited in claim 4 wherein said resistance means comprise a diode, with at least one diode included in an electrical current path defined by each of said conductors.

6. A spatial filter as recited in claim 5 wherein said network is supported on a substrate and said means for locating secures said network with said conductors about $\lambda/4$ from said reflector, wherein $\lambda$ is an average wavelength of energy emitted by said antenna.

7. A spatial filter as recited in claim 6 wherein said network comprises two connected sub-networks, each sub-network comprising segments of conductors connected in series with at least one diode in each segment, conductor segments in a sub-network perpendicular to conductor segments of another sub-network.

8. A spatial filter as recited in claim 7 with nodes at intersections of substantially perpendicular conductors, a pair of plates at each said node, each such plate connecting two different conductor segments.

9. A spatial filter as recited in claim 8 wherein said pair of plates have a ring-like shape, each said plate comprising a symmetrical half ring, insulated from a half ring of said pair.

* * * * *